US007179001B2

(12) United States Patent
Akaiwa

(10) Patent No.: US 7,179,001 B2
(45) Date of Patent: Feb. 20, 2007

(54) PRINTING-AND-EMBOSSING COMPOSITE APPARATUS, CONTROLLING METHOD FOR PRINTING-AND-EMBOSSING COMPOSITE APPARATUS, AND PROGRAM

(75) Inventor: Masao Akaiwa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/386,232

(22) Filed: Mar. 21, 2006

(65) Prior Publication Data

US 2006/0228144 A1 Oct. 12, 2006

(30) Foreign Application Priority Data

Apr. 6, 2005 (JP) ..... 2005-110381

(51) Int. Cl.
*B41J 3/32* (2006.01)

(52) U.S. Cl. ..... 400/109.1; 400/483

(58) Field of Classification Search ..... 400/109.1, 400/483

See application file for complete search history.

(56) References Cited

U.S. PATENT DOCUMENTS 5,193,921 A * 3/1993 Tsukuda et al. ..... 400/109.1
7,112,000 B2 * 9/2006 Kurashina et al. ..... 400/109.1
2002/0009318 A1 * 1/2002 Maie ..... 400/109.1
2005/0281599 A1 * 12/2005 Akaiwa ..... 400/109.1
2005/0281600 A1 * 12/2005 Akaiwa et al. ..... 400/109.1

FOREIGN PATENT DOCUMENTS

JP 10-275206 10/1998
JP 2001-088358 4/2001

* cited by examiner

*Primary Examiner*—Minh Chau
(74) *Attorney, Agent, or Firm*—Hogan & Hartson LLP

(57) ABSTRACT

There is provided a printing-and-embossing composite apparatus which performs a printing process of a symbol image and an embossing process of a braille character on the same process sheet, the apparatus including: a printing-area setting device for setting a printing area for the symbol image on the process sheet; an embossing-area setting device for setting an embossing area for the braille character on the process sheet; and a notifying device for issuing an alarm when the printing area and the embossing area are at least partially overlapped with each other.

7 Claims, 10 Drawing Sheets

Fig. 5A T1 : 24 MM TAPE-WIDTH
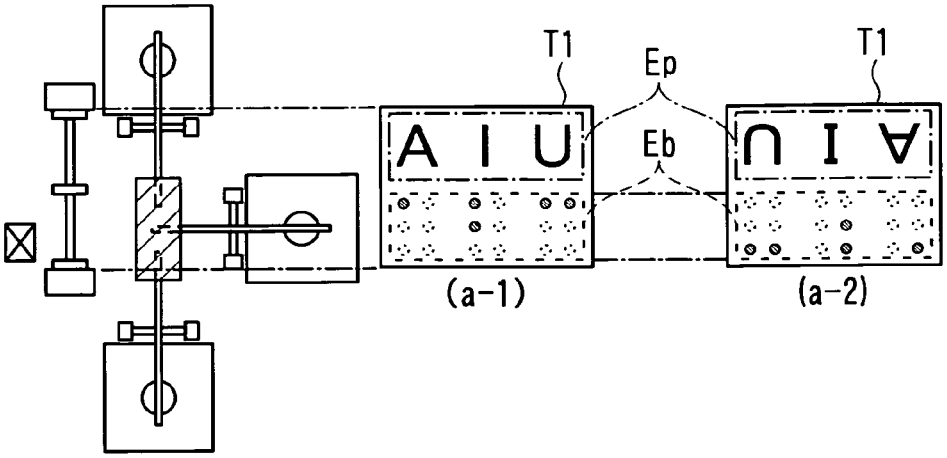
Fig. 5B T2 : 18 MM TAPE-WIDTH
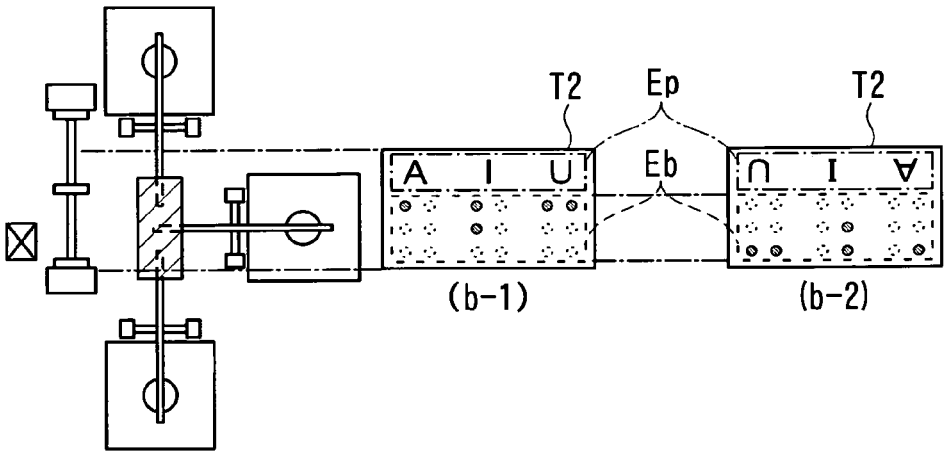
Fig. 5C T3:12 MM TAPE-WIDTH
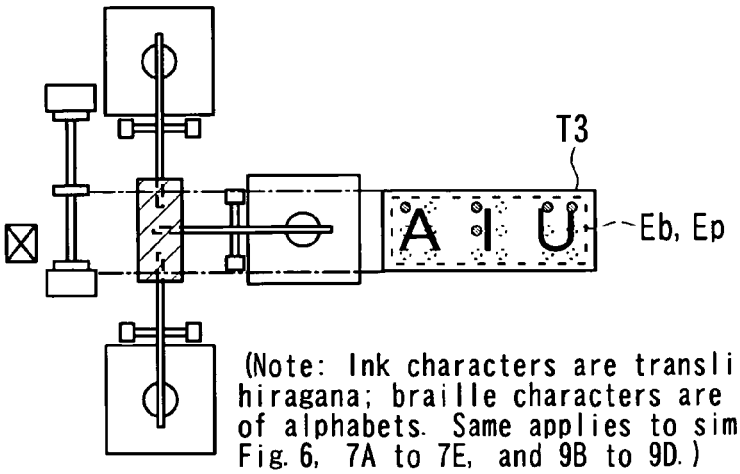
(Note: Ink characters are transliteration of Japanese hiragana; braille characters are those of hiragana, not of alphabets. Same applies to similar figures such as Fig. 6, 7A to 7E, and 9B to 9D.)

《DETERMINED AS CASES IN WHICH PRINTING AREA FOR BAR CODE AND EMBOSSING AREA FOR BRAILLE CHARACTERS ARE OVERLAPPED》

OVERLAPPED LAYOUT OF INK CHARACTERS AND BRAILLE CHARACTERS

OVERLAPPED LAYOUT OF INK CHARACTERS AND BRAILLE CHARACTERS

《DETERMINED AS CASES IN WHICH PRINTING AREA FOR BAR CODE AND EMBOSSING AREA FOR BRAILLE CHARACTERS ARE NOT OVERLAPPED》

OVERLAPPED LAYOUT OF INK CHARACTERS AND BRAILLE CHARACTERS

NON-OVERLAPPED LAYOUT OF INK CHARACTERS AND BRAILLE CHARACTERS

INK CHARACTERS ON UPPER SUDE AND BRAILLE CHARACTERS ON LOWER SIDE

Fig. 8
BAR CODE S1
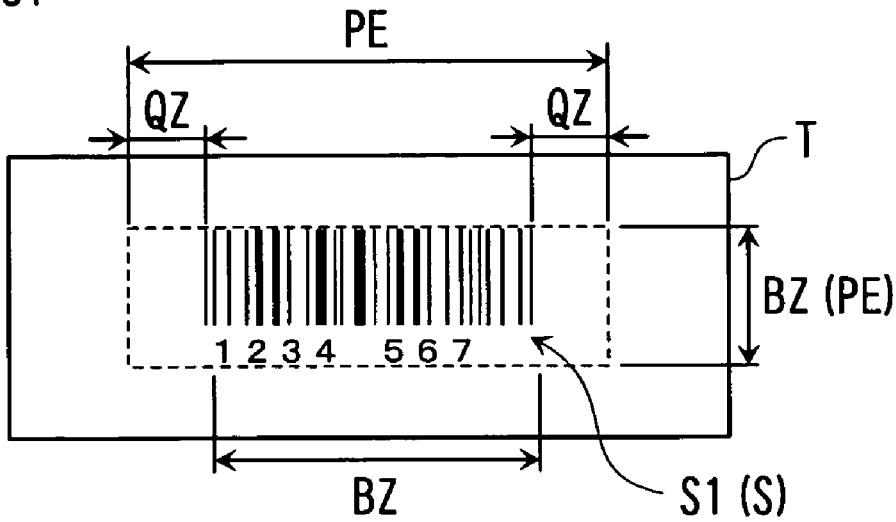
TWO-DIMENSIONAL S2
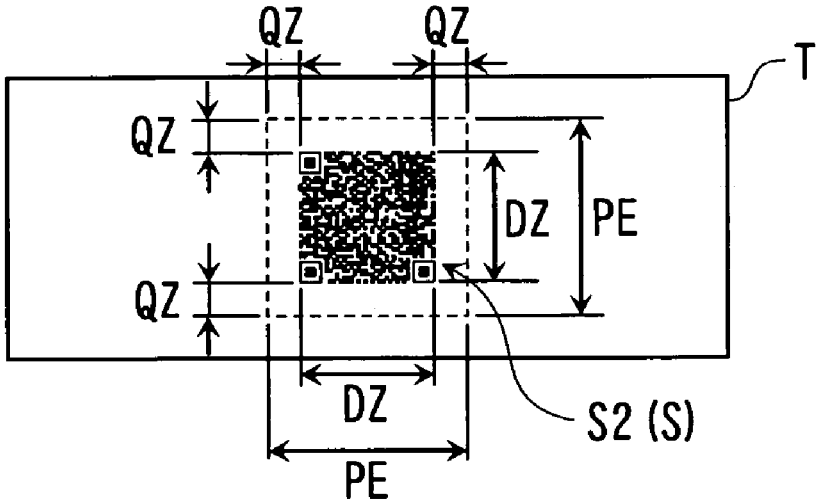

《DETERMINED AS CASES IN WHICH PRINTING AREA FOR BAR CODE AND EMBOSSING AREA FOR BRAILLE CHARACTERS ARE OVERLAPPED》

《DETERMINED AS CASES IN WHICH PRINTING AREA FOR BAR CODE AND EMBOSSING AREA FOR BRAILLE CHARACTERS ARE NOT OVERLAPPED》

PRINTING-AND-EMBOSSING COMPOSITE APPARATUS, CONTROLLING METHOD FOR PRINTING-AND-EMBOSSING COMPOSITE APPARATUS, AND PROGRAM

The entire disclosure of Japanese Patent Application No. 2005-110381, filed Apr. 6, 2005, is expressly incorporated by reference herein.

BACKGROUND

1. Technical Field

The present invention relates to a printing-and-embossing composite apparatus, a controlling method for a printing-and-embossing composite apparatus, and a program, for printing ink characters and embossing braille characters on the same process sheet.

2. Related Art

A known braille label is of a type in which braille characters recognizable by visually-impaired persons and ink characters recognizable by visually-normal persons are arranged side by side or overlapped with each other on the same process sheet (e.g., tape) in such a manner that they are recognizable by both visually-impaired and visually-normal persons. Reference is made to JP-A-10-275206 as an example of related art. Furthermore, a known information processing apparatus is of a type which simultaneously performs an ink-character printing and a braille embossing so as to form the above-described braille label. Reference is made to JP-A-2001-88358 as an example of related art.

Meanwhile, braille characters are recognized by touch-reading and thus not colored, whereas ink characters are visually recognized. Therefore, even if braille characters and ink characters are overlapped with each other, both can be recognized as a rule. Irrespective of the arrangement of braille characters, editing of ink characters is performed based on the premise that the ink characters can be recognized. However, when braille characters are overlappingly arranged at the area where symbol images such as a bar code and a two-dimensional code are printed as ink characters, there is a possibility of the appropriate reading of the symbol images being hindered. Besides, a bar code and a two-dimensional code have predetermined blank areas (quiet zones) for reading the same on the upper/lower and left/right sides thereof. Therefore, even if symbol images and braille characters are not overlapped with each other, there is also a possibility of the appropriate reading of the symbol images being hindered.

SUMMARY

It is an advantage of the invention to provide an printing-and-embossing composite apparatus, a controlling method for a printing-and-embossing composite apparatus, and a program, which are capable of printing symbol images and embossing braille characters so as not to hinder the reading of the symbol images when the symbol images are printed and the braille characters are embossed on the same process sheet.

According to one aspect of the invention, there is provided a printing-and-embossing composite apparatus which performs a printing process of a symbol image and an embossing process of a braille character on the same process sheet. The apparatus comprises: a printing-area setting device for setting a printing area for the symbol image on the process sheet; an embossing-area setting device for setting an embossing area for the braille character on the process sheet; and a notifying device for issuing an alarm when the printing area and the embossing area are at least partially overlapped with each other.

According to another aspect of the invention, there is provided a controlling method for a printing-and-embossing composite apparatus which performs a printing process of a symbol image and an embossing process of a braille character on the same process sheet. The method comprises issuing an alarm when a printing area for the symbol image and an embossing area for the braille character are at least partially overlapped with each other on the process sheet.

According to these configurations, an alarm is issued when a printing area for symbol images and an embossing area for braille characters are at least partially overlapped with each other at the points where they are set. Therefore, the user can recognize a state in which the printing area and the embossing area are at least partially overlapped with each other before the printing process of the symbol images and the embossing process of the braille characters are performed. In other words, it is possible for the user to recognize the possibility of hindering the reading of the printed symbol images. Thus, there is no possibility of embossing the braille characters in a state of being overlapped with the printing area for the symbol images against the user's intention. Furthermore, "symbol images" refer to images obtained by coding (encoding) information in accordance with an arbitrary symbol code system (symbology), and examples thereof include a bar code and a two-dimensional code (such as QR code, Maxi code, Veri code, Data Matrix, and PDR417).

In this case, it is preferable that the printing-and-embossing composite apparatus further comprise a process disabling device for disabling the printing process and/or the embossing process when the printing area and the embossing area are at least partially overlapped with each other.

Preferably, in this case, the printing process and/or embossing process are/is disabled when the printing area and the embossing area are at least partially overlapped with each other.

According to this configuration, the printing process and/or the embossing process are/is disabled when the printing area for the symbol images and the embossing area for the braille characters are set in a state of being at least partially overlapped with each other. Therefore, it is possible to entirely prevent the possibility of hindering the reading of the printed symbol images.

In this case, it is preferable that the printing area be formed of an actual printing area for the symbol image and a quiet zone arranged at the periphery thereof.

According to this configuration, predetermined blank areas for reading the symbol image, namely quiet zones are included in the printing area for the symbol image. Therefore, it is possible to previously prevent braille characters from being embossed in a state of being overlapped with the quiet zones of the symbol image.

In this case, it is preferable that the symbol image represent a bar code or a two-dimensional code.

According to this configuration, even when a bar code or a two-dimensional code is particularly printed as a symbol image, there is no possibility that braille characters are embossed in a state of being overlapped with the printing area for the bar code or the two-dimensional code.

According to still another aspect of the invention, there is provided a program which causes a computer to perform each device of the printing-and-embossing composite apparatus described above.

According to this configuration, it is possible to provide a program for printing the symbol image and embossing the braille characters so as not to hinder the reading of the symbol image.

BRIEF DESCRIPTION OF THE DRAWINGS

The invention will be described with reference to the accompanying drawings, wherein like numbers reference like elements.

FIGS. 5A to 5C each show an explanatory drawing for explaining a process mode for the label forming apparatus.

FIG. 8 shows an explanatory drawing for explaining the detail of the printing area for a symbol image.

DESCRIPTION OF EXEMPLARY EMBODIMENTS

Hereinafter, referring to the accompanying drawings, description will be made about a case in which a printing-and-embossing composite apparatus according to an embodiment of the invention is applied to a label forming apparatus. The label forming apparatus has an ink-character printing section and a braille embossing section. The ink-character printing section performs an ink-character printing on a process sheet, and the printed part of the process sheet is cut into a tape piece. The tape piece is then manually inserted into the braille embossing section and embossed in braille.

Figure 1:
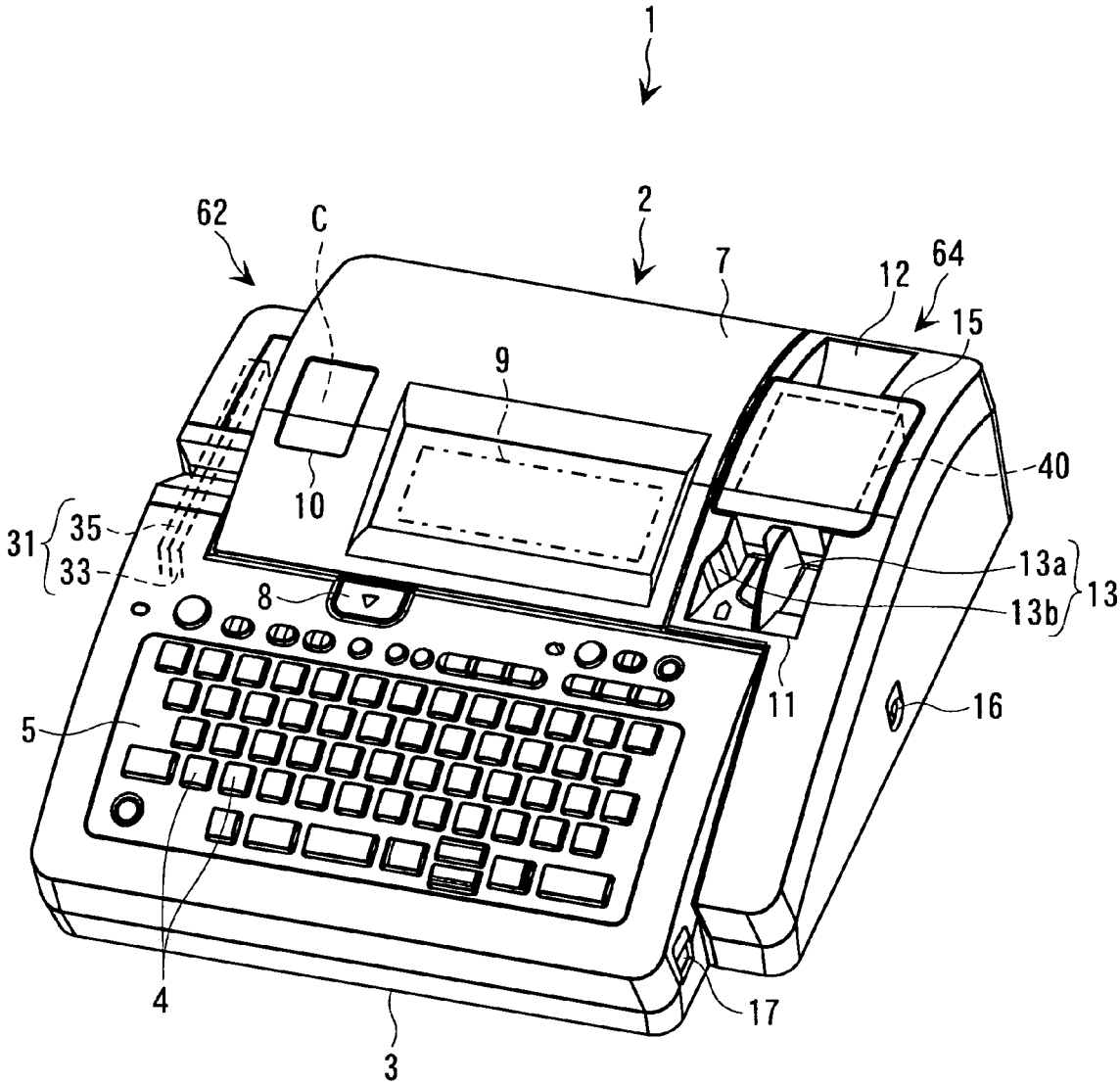
FIG. 1 shows an external perspective view of a label forming apparatus with its cover closed.
Figure 2:
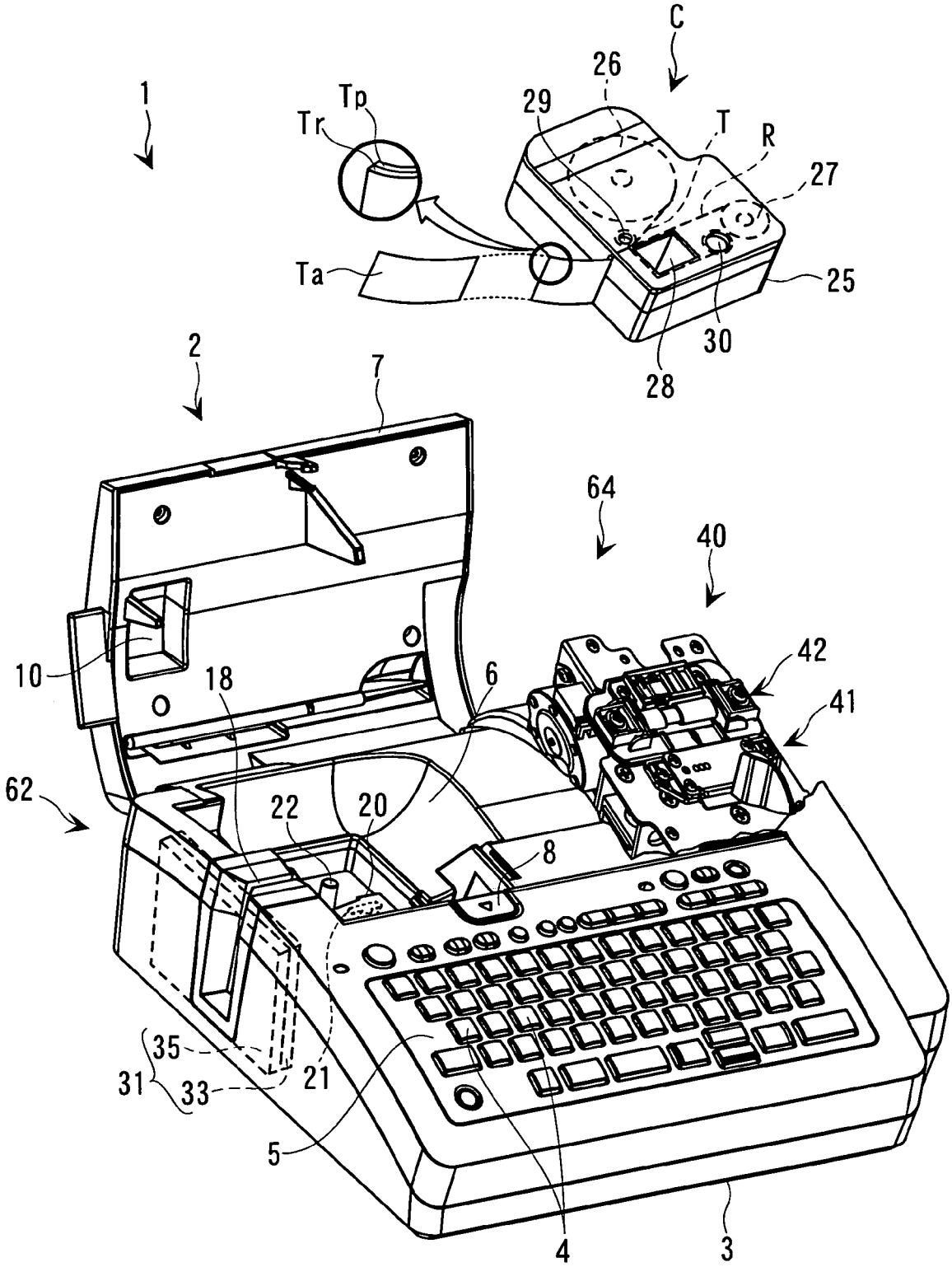
FIG. 2 shows an external perspective view of the label forming apparatus with its cover opened.

FIGS. 1 and 2 show external perspective views of the label forming apparatus with its cover closed and opened, respectively. As shown in FIGS. 1 and 2, the label forming apparatus 1 has an apparatus main body 2 which prints ink characters on the process tape T and embosses braille characters on the tape piece Ta (see FIG. 2) of the process tape T and a tape cartridge C accommodating the process tape T and an ink ribbon R and detachably attached to the apparatus main body 2.

The apparatus main body 2 has an outer shell formed by an apparatus casing 3 in which the ink-character printing section 62 is widely arranged, and the braille embossing section 64 is arranged at the rear-half part on the right side of the apparatus casing 3. The front casing 3 has a keyboard 5 including various keys 4 disposed at the top surface on the front-half side thereof. At the top surface on the rear-half side of the apparatus casing 3 is widely provided an opening and closing lid 7. On the near side of the opening and closing lid 7 is provided a lid opening button 8 for opening the same. On the front side of the opening and closing lid 7 are provided a rectangular display 9 for displaying results or the like inputted from the keyboard 5.

Inside the opening and closing lid 7 is provided a recessed cartridge mounting section 6 for mounting the tape cartridge C. In the cartridge mounting section 6 is disposed a print head 21 for printing ink characters on the process tape T reeled out from the tape cartridge C (see FIG. 2).

On the left side of the apparatus casing 3 is formed a print-tape ejecting slot 18 for communicating the cartridge mounting section 6 with the outside of the apparatus. The apparatus casing 3 includes a cutter unit 31 for cutting off the process tape T, which faces on the print-tape ejecting slot 18. The cutter unit 31 is disposed so as to face on the print-tape ejecting slot 18 and has a full cutter 33 and a half cutter 35. The full cutter 33 is driven by a motor (full-cutter motor 32: see FIG. 4) to cut off the process tape T like scissors, and the half cutter 35 equipped with a stopper is disposed on the downstream side in the tape-feeding direction relative to the full cutter 33 and driven by a motor (half-cutter motor 34; see FIG. 4) to cut only the below-described recording tape Tr of the process sheet T like scissors. After this half-cutting operation, the process tape T will have a margin (not shown) formed at the tip-end part thereof in the direction in which the process tape is inserted into the below-described embossing assembly 40.

On the other hand, at the right top-surface on the rear-half side of the apparatus casing 3 is disposed a braille embossing section 64. The braille embossing section 64 has an embossing-tape inserting section (sheet inserting section) 11 into which the tape piece Ta is manually inserted from the front side of the embossing-tape inserting section with its printing surface directed upward and an embossing-tape ejecting section 12 from which the tape piece Ta embossed in braille is ejected backward. The embossing-tape inserting section 11 is provided with a manual inserting guide 13 with which a width of the tape piece Ta can be adjusted. Note that reference numeral 15 denotes an embossing section cover for covering the embossing assembly 40.

On the right side of the apparatus casing 3 are formed a power supply port 16 for supplying power and a connecting port 17 (interface) for connecting to external apparatuses such as personal computers not shown. According to this configuration, the external apparatuses can be connected to the connecting port 17, which in turn makes it possible to perform an ink-character printing and a braille embossing based on character information or the like generated by the external apparatuses. Furthermore, although omitted in the figures, the apparatus casing 3 has a circuit board constituting a controlling section 60 (see FIG. 4) for comprehensively controlling the apparatus casing 2 mounted therein.

The cartridge mounting section 6 has the print head 21 having a heater element and covered with a head cover 20, a positioning boss 22 for positioning the below-described tape reel 26, a platen driving shaft (not shown) for feeding the process tape T and the ink ribbon R of the tape cartridge C and placed opposite to the print head 21, and a take-up driving shaft (not shown) for taking up the ink ribbon R, all of which are projectingly provided in the cartridge mounting section 6. Furthermore, at the corner of the cartridge mounting section 6 is provided a tape discriminating sensor 23 (see FIG. 4) composed of a plurality of micro switches. In a bottom plate of the cartridge mounting section 6 are incorporated a print-feeding motor 24 (see FIG. 4) for driving the platen driving shaft and the take-up driving shaft, a reduction gear train (not shown), or the like.

The tape cartridge C has a cartridge casing 25 in which are accommodated a tape reel 26 winding the process tape T, a ribbon feeding reel 27 winding the ink ribbon R, and a ribbon taking-up reel 30. The ribbon feeding reel 27 and the ribbon taking-up reel 30 are positioned on the right lower side of the cartridge casing. Furthermore, around the left lower side of the tape reel 26 is formed a through-hole 28 into which the head cover 20 covering the print head 21 is inserted. Besides, at a position where the process tape T and the ink ribbon R overlap each other is arranged a platen roller 29 which is engaged with the platen driving shaft and rotates therewith.

When the tape cartridge C is mounted on the cartridge mounting section 6, the head cover 20, the positioning boss 22, the take-up driving shaft, and the platen driving shaft are inserted into the through hole 28, the tape reel 26, the ribbon taking-up reel 30, and the platen roller 29, respectively. When the opening and closing lid 7 is closed in this state, the print head 21 and the platen roller 29 are successively brought into contact with each other and sandwich the process tape T and the ink ribbon R therebetween, to create a printing standby state. Then, the platen driving shaft and the take-up driving shaft cyclically rotate based on ink-character data generated by the controlling section 60 corresponding to character information inputted from the keyboard 5 or the like, and the print head 21 performs an ink-character printing while the process tape T and the ink ribbon R are fed. At the same time, the ink ribbon R fed out from the ribbon feeding reel 27 travels around walls of the through hole 28 and is taken up by the ribbon taking-up reel 30. On the process tape T printed with ink characters is formed the margin (not shown) by the half cutter 35, and the printed part of the process tape T is cut by the full cutter 33. The cut tape piece Ta is ejected to the outside from the printing-tape ejecting port 18.

The process tape T is composed of the recording tape Tr made of PET (polyethylene terephthalate) and having an adhesive agent layer coated on the rear surface thereof and the peeling tape Tp made of PET and affixed to the recording tape Tr with the adhesive agent layer. The process tape T is accommodated in the cartridge casing 25 in a rolled state with its recording tape Tr and peeling tape Tp directed outward and inward, respectively. The process tape T is of a plurality of types, each having a different tape width. On the rear surface of the cartridge casing C are formed a plurality of small holes to be detected (not shown). The tape discriminating sensor 23 described above discriminates the plurality of holes to be detected so that the type of the process tape T can be discriminated.

As shown in FIG. 5A, the embossing assembly 40 faces on a tape traveling path 36 linearly connecting the embossing-tape inserting section 11 and the embossing-tape ejecting section 12 and has an embossing unit 41 (braille embossing device) and a tape feeding unit 42. The embossing unit 41 performs a braille embossing and is disposed adjacent to the half part on the cartridge mounting section 6 side in the width direction of the tape traveling path 36, and the tape feeding unit 42 feeds the tape piece Ta manually inserted from the embossing-tape inserting section 11 to the embossing-tape ejecting section 12.

The tape feeding unit 42 has feeding rollers 44 which are rotated to feed the tape piece Ta, roller-shaft supporting part 45 for pivotally supporting the feeding rollers 44, a reversely rotatable embossing-feeding motor 43 (see FIG. 4) for rotating the feeding rollers 44, a power transmitting mechanism (not shown) for transmitting the power of the embossing-feeding motor 43 to the feeding rollers 44, and a tip-end detecting mechanism 46 for detecting the tip end of the tape piece Ta to be fed. In accordance with the driving of the embossing-feeding motor 43, the feeding rollers 44 are rotated through the power transmitting mechanism to feed the tape piece Ta. The tip-end detecting mechanism 46 detects the tip end of the tape piece Ta fed, as a result of which the embossing unit 41 starts performing a braille embossing.

Figure 3A:
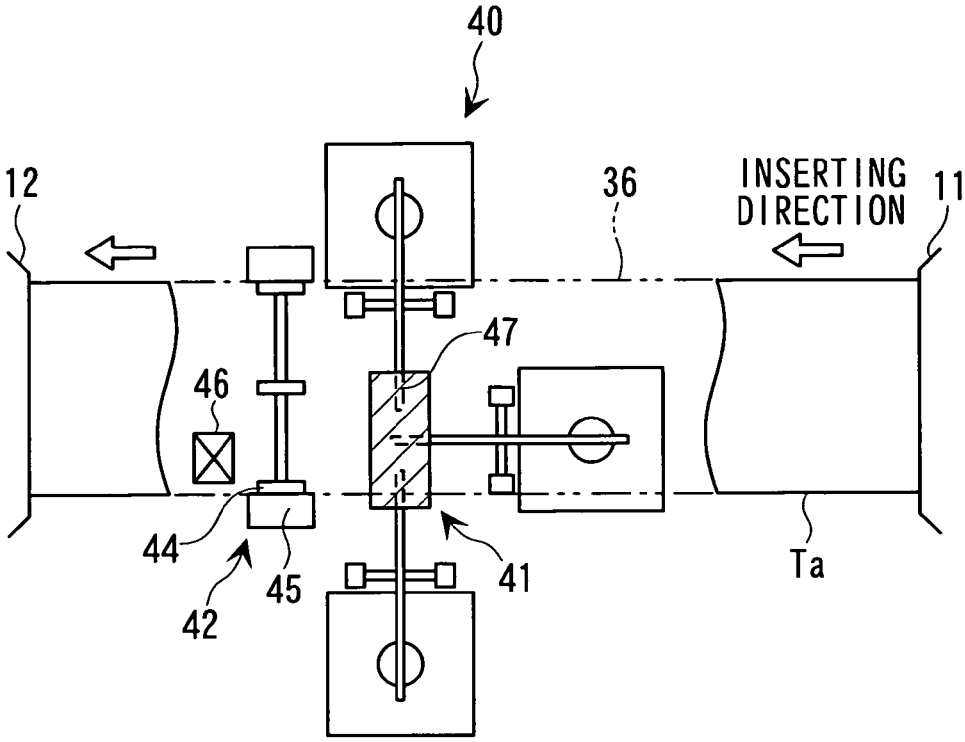
FIGS. 3A and 3B show a plan view and a cross-sectional view of an embossing unit, respectively.
Figure 3B:
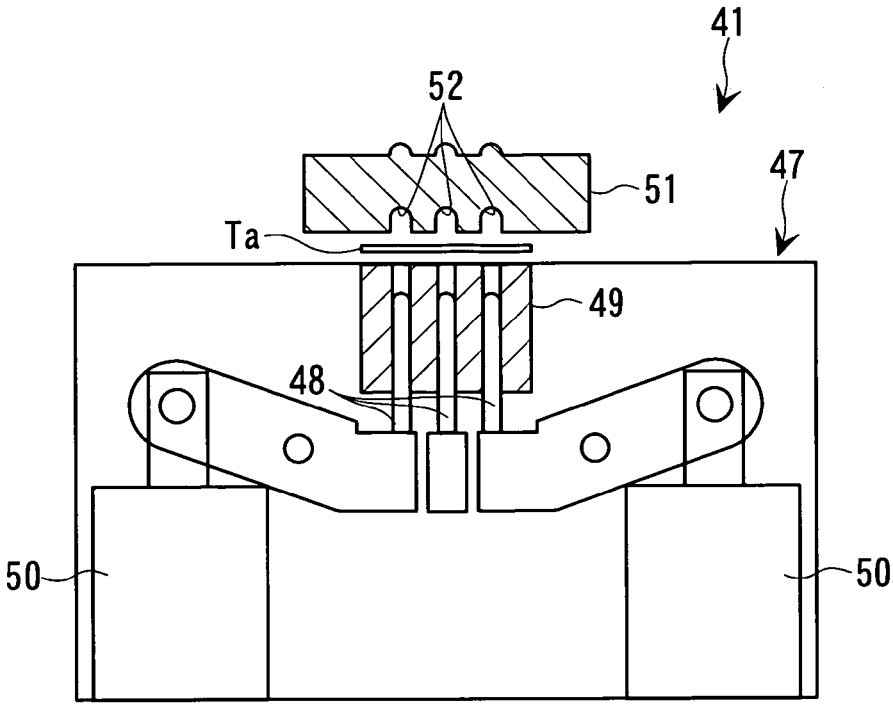

As shown in FIG. 3B, the embossing unit 41 is disposed on the upstream side in the tape-feeding direction relative to the feeding rollers 47 and composed of an embossing section 47 provided on the lower side of the inserted tape piece Ta and an embossing receiving section 51 provided at a position opposite to the embossing section 47. Of the six embossing salients constituting a braille character (braille character represented by six points), the embossing section 47 has three embossing pins 48 arranged to correspond to three vertically-aligned embossing salients, an embossing guide block 49 for guiding the embossing movement of the three embossing pins 48 back and forth, and three solenoids 50 as a driving source. The embossing receiving section 51 has three receiving grooves 52 formed therein corresponding to the three embossing pins 48. While the tape piece Ta is fed by the tape feeding unit 42, the three embossing pins 48 are selectively jumped into the receiving grooves 52 by the three solenoids 50 as the driving source to perform an embossing operation. As a result, the tape piece Ta has an embossing salient made of the so-called six-point braille character formed thereon.

Figure 4:
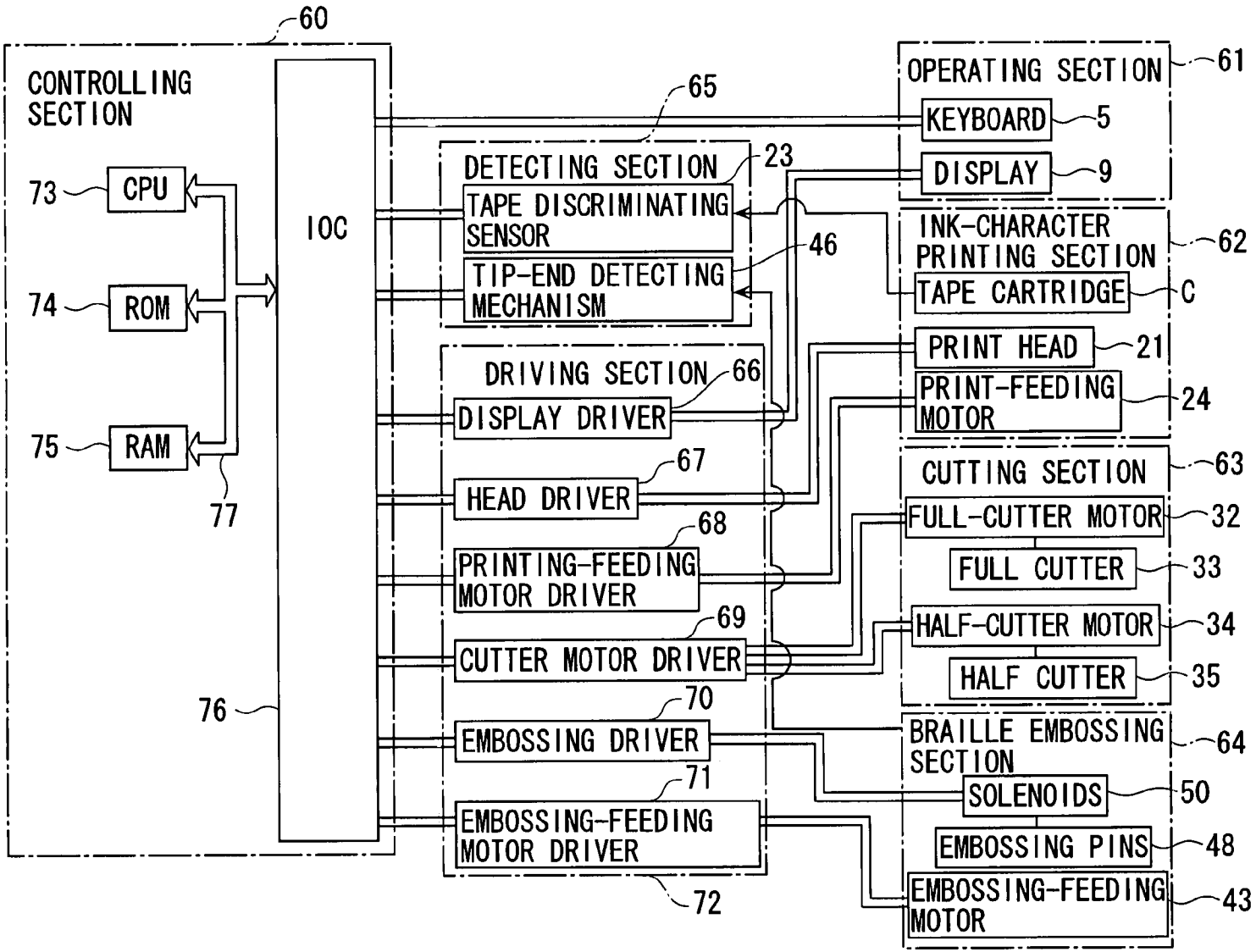
FIG. 4 shows a control block diagram of the label forming apparatus.

Referring next to FIG. 4, description will be made about a configuration of a control system of the label forming apparatus 1. The label forming apparatus 1 is composed of an operating section 61, the ink-character printing section 62, and a cutting section 63. The operating section 61 has the keyboard 5 and the display 9 and serves as a user interface by which the user, for example, inputs character information and displays various information. The ink-character printing section 62 has the tape cartridge C, the print head 21, and the print-feeding motor 24 and prints ink-character data on the process tape T based on inputted character information as the-process tape T and the ink ribbon R are fed. The cutting section 63 has the full cutter 33, the half cutter 35, a full-cutter motor 32, and a half-cutter motor 34 and performs a full-cutting operation and a half-cutting operation on the printed process tape T.

The label forming apparatus 1 is further composed of the braille embossing section 64, a detecting section 65, a driving section 72, and the controlling section 60. The braille embossing section 64 has the solenoids 50, the embossing pins 48, and the embossing-feeding motor 43 and embosses braille-characters data on the tape piece Ta based on character information as the tape piece Ta is fed. The detecting section 65 has various sensors such as the tape discriminating sensor 23 and the tip-end detecting mechanism 46 and performs various detections. The driving section 72 has a display driver 66, a head driver 67, a printing-feeding motor driver 68, a cutter motor driver 69, an embossing driver 70, and an embossing-feeding motor driver 71 and drives each of the above-described sections. The controlling section 60 is connected to the sections and controls the label forming apparatus 1 entirely.

The controlling section 60 has a CPU 73, a ROM 74, a RAM 75, and an IOC 76 (Input Output Controller), all of which are connected to one another through an internal bus 77. The CPU 73 inputs various signals and data from each of the sections in the label forming apparatus 1 through the IOC in accordance with control programs of the ROM 74. The CPU 73 processes various data of the RAM 75 based on the inputted various signals and data and outputs the various signals and data to each of the sections in the label forming apparatus 1 through the IOC 76, to thereby control an ink-character printing process and a braille embossing process.

With this controlling operation, it is made possible to perform various processes on the process tape T. For example, it is, of course, possible that the process tape T is printed with ink characters and cut off so that the tape piece Ta can be obtained, and the tape piece Ta is then embossed in braille to have both ink characters and braille characters formed thereon. It is also possible to obtain the tape piece Ta having only ink characters printed thereon without the braille embossing process. Furthermore, it is possible to obtain the tape piece Ta having only braille characters embossed thereon without the ink-character printing process. Note that the processed tape piece Ta is to be affixed to an object as a label with ink characters and braille characters, a label with ink characters, and a label with braille characters.

Furthermore, in forming the tape piece Ta on which both an ink-character printing and a braille embossing are performed, the user can set a desired printing and embossing layout through a key operation using the keyboard 3 (the detailed description of the operating procedure will be omitted). As shown in FIGS. 5A to 5C, when a tape T1 with a width of 24 mm is used (see FIG. 5A), the user can select a layout either with a printing arrangement area Ep located on the upper side and an embossing arrangement area Eb located on the lower side (a-1) or with a printing arrangement area Ep located on the lower side and an embossing arrangement area Eb located on the upper side (a-2).

Furthermore, when a tape T2 with a width of 18 mm is used (see FIG. 5B), the user can select a layout either with a printing arrangement area Ep located on the upper side and an embossing arrangement area Eb located on the lower side (b-1) or with a printing arrangement area Ep located on the lower side and an embossing arrangement area Eb located on the upper side (b-2). In this case, however, the printing arrangement area Ep is shortened in the tape width direction in response to the tape width involved. Note that, when the tapes T1 and T2 are used, the user can select a layout either with ink characters printed in a desired size partially overlapped with braille characters or with a printing arrangement area Ep and an embossing arrangement area Eb arranged side by side in the longitudinal direction of each of the tapes, in addition to the above-described layouts.

When a tape T3 with a width of 12 mm is used (see FIG. 5C), the user can select only a layout with a printing arrangement area Ep and an embossing arrangement area Eb overlapped with each other because the width of the tape is the minimum length required for embossing one cell of braille (length in the tape width direction) (however, it is possible to arrange the printing arrangement area Ep and the embossing arrangement area Eb side by side in the longitudinal direction of the tape).

Meanwhile, the label forming apparatus 1 according to the present embodiment is capable of printing a symbol image S (see FIG. 8) such as a bar code and a two-dimensional code. Furthermore, as described above, the label forming apparatus 1 is capable of performing an ink-character printing and a braille embossing on the same process tape T. However, when braille characters are embossed in such a manner as to overlap with the symbol image S, there is a possibility of the appropriate reading of the symbol image S being hindered. Therefore, the label forming apparatus 1 of the present embodiment exercises control to issue an alarm to the user when braille characters might be embossed in such a manner as to overlap with the symbol image S. Hereinafter, description of the control will be made below.

Figure 6:
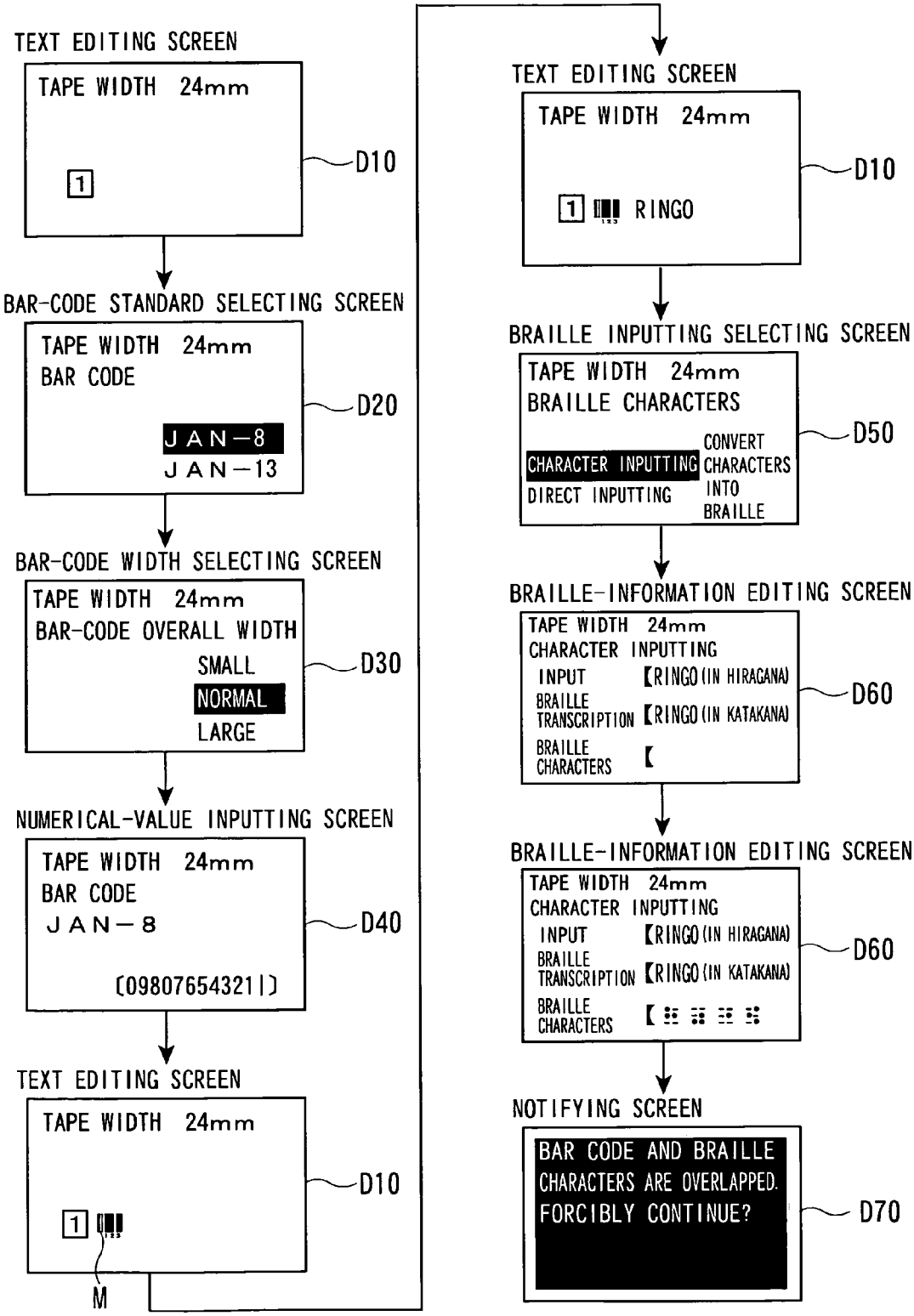
FIG. 6 shows an explanatory drawing for explaining a procedure of inputting ink-character information including a bar code.

Referring to FIG. 6, description will primarily be made about the operating procedure by the user when a bar code S1 as the symbol image S is printed and braille characters are then embossed on the tape T with a width of 24 mm. When the user selects a bar-code inserting key for example while a normal text-inputting screen D1 is displayed, a bar-code standard selecting screen D20 which selects the right standard of the bar code S1 to be inserted is displayed. Note that, on the bar-code standard selecting screen D20 are displayed two types of standards including "JAN-8" and "JAN-13" as candidates. In addition, various other standards of bar codes such as "ITF," "NW-7," "CODE 39," "UPC-A," and "UPC-E" are also available.

When the user selects a standard of the bar code S1 to be printed ("JAN-8" is selected in the figure) on the bar-code standard selecting screen D20 on, a bar-code width selecting screen D30 which selects a width of the bar code S1 is then displayed. On the bar-code width selecting screen D30, the user can select a width of the bar code S1 to be printed from among "SMALL," "NORMAL," and "LARGE." When a width of the bar code S1 is selected ("NORMAL" is selected in the figure), a numerical-value inputting screen D40 for inputting a numerical value of the bar code S1 is then displayed. On the numerical-value inputting screen D40, the user inputs a numerical value of the bar code S1 (a string of "09807654321" is inputted in the figure).

When the inputting of the numerical value of the bar code S1 is completed on the numerical-value inputting screen D40, the text inputting screen D10 is displayed again, and a bar-code mark M is displayed to imply that the bar code S1 has been inputted therein. The user inputs ink-character information subsequent to the inputting of the bar code S1 as needed (a character string of "RINGO," Japanese representing apple is inputted in the figure). Furthermore, when a braille inputting key is selected, a braille inputting screen D50 is displayed to select an inputting mode from either one in which braille information is inputted by a normal character inputting (CHARACTER INPUTTING) or the other in which an embossing point is inputted by an direct specification (DIRECT INPUTTING). When the user selects the inputting mode ("DIRECT INPUTTING" is selected in the figure), a braille-information editing screen D60 is then displayed. The user inputs braille information on the braille-information editing screen D60 (the character string of "RINGO" is inputted in the figure). Note that the label forming apparatus 1 may be of a configuration in which the information inputted on the text editing screen D10 is initially displayed when the screen changes to the braille-information editing screen D60. With this configuration, it is possible to save the work of inputting when the same information is used for printing ink characters and embossing braille characters.

When the user determines the way of inputting the braille information with a prescribed key operation, katakana notation and braille-character notation are each previewed on the braille-information editing screen D60 in addition to hiragana notation of the determined braille information. When the user instructs thereafter to start a printing process, the label forming apparatus 1 sets a printing area for ink-character information and an embossing area for braille information based on the inputted information and the selected layout. When there is a possibility that the printing area PE for the bar code S1 and the embossing area HE for the braille characters are at least partially overlapped with each other as a result of setting these areas, a notifying screen D70 is displayed to notify the user to that effect. After visually recognizing the notifying screen D70, the user can select whether or not the printing process and the braille embossing process should be forcibly continued with a prescribed key operation.

FIGS. 7A to 7E each show a case in which the ink-character information (including the bar code S1) and the braille information inputted by the procedure shown in FIG. 6 are printed and embossed on the tape T with a width of 24 mm. They provide layout examples such as a case in which the label forming apparatus 1 determines that the printing area PE for the bar code S1 and the embossing area HE for the braille characters are at least partially overlapped with each other, or that in which it determines that the printing area PE for the bar code S1 and the embossing area HE for the braille characters are not overlapped with each other.

Figure 7A:
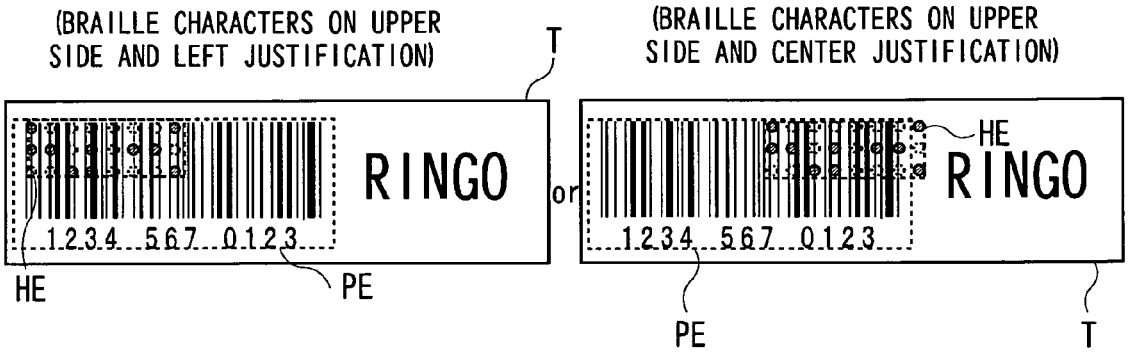
FIGS. 7A to 7E each show a layout of a tape with a width of 24 mm in which a printing area for a bar code and an embossing area for braille characters are overlapped with each other, and that in which the printing area for a bar code and the embossing area for braille characters are not overlapped with each other.
Figure 7B:
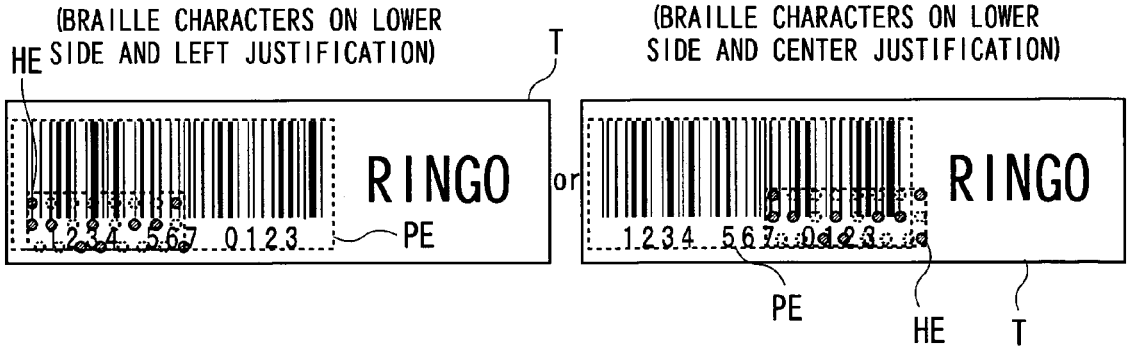

FIG. 7A shows examples in which the user sets a braille embossing area to either "UPPER SIDE AND LEFT JUSTIFICATION" or "UPPER SIDE AND CENTER JUSTIFICATION" under the overlapped layout of "INK CHARACTERS AND BRAILLE CHARACTERS" where ink characters (i.e., bar code) printed in a desired size are partially overlapped with braille characters. FIG. 7B shows examples in which the user sets a braille embossing area to either "LOWER SIDE AND LEFT JUSTIFICATION" or "LOWER SIDE AND CENTER JUSTIFICATION." As for both the examples of FIGS. 7A and 7B, the label forming apparatus 1 determines that the printing area PE for the bar code S1 and the embossing area HE for the braille characters are at least partially overlapped with each other, with the result that the notifying screen D70 (see FIG. 6) is displayed.

Figure 7C:
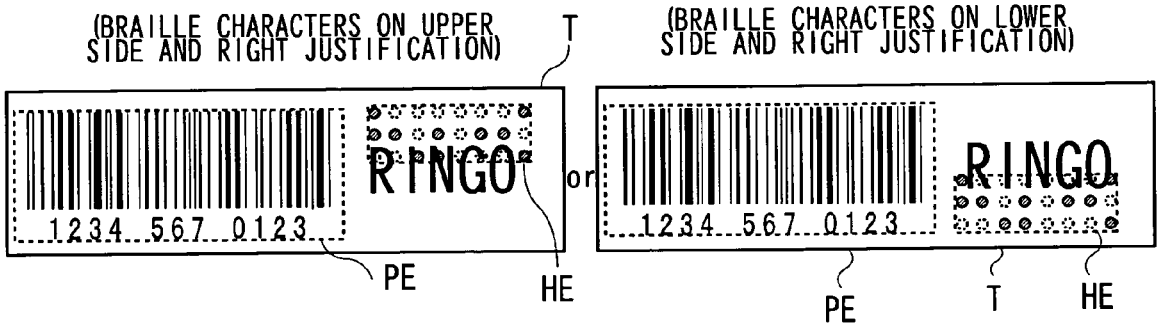
Figure 7D:
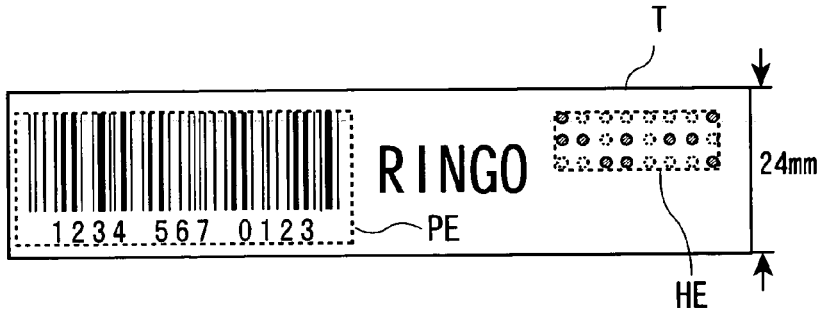

On the other hand, FIG. 7C shows examples in which the user sets a braille embossing area to either "UPPER SIDE AND RIGHT JUSTIFICATION" or "LOWER SIDE AND RIGHT JUSTIFICATION" under the overlapped layout of "INK CHARACTERS AND BRAILLE CHARACTERS" where ink characters (i.e., characters of RINGO) printed in a desired size are partially overlapped with braille characters. FIG. 7D shows an example in which the user employs a layout of the non-overlapped type of "INK CHARACERS AND BRAILLE CHARACTERS" where a printing area for ink-character information and an embossing area for braille information are arranged side by side in the longitudinal direction of the tape T. As for both the examples of FIGS. 7C and 7D, the label forming apparatus 1 determines that the printing area PE for the bar code S1 and the embossing area HE for the braille characters are not overlapped with each other, and an ink-character printing process and a braille embossing process are performed without displaying the notifying screen D70 (see FIG. 6).

Figure 7E:
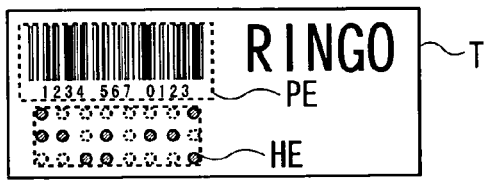

FIG. 7E shows an example in which the user sets a layout to "INK CHARACTERS ON THE UPPER SIDE AND BRAILLE CHARACTERS ON THE LOWER SIDE" where a printing area for ink-character information and an embossing area for braille information are fixedly arranged on the upper side and the lower side, respectively. In this case, the sizes of the bar code S1 and the characters of "RINGO" inputted as ink-character information are automatically adjusted such that the entire ink characters are printed on the upper half side of the tape T. In other words, the label forming apparatus 1 sets the size of the ink-character information to be printed (the bar code and the characters of "RINGO") in response to the width of the tape T mounted thereon. In this case, as in the examples of FIGS. 7C and 7D, the label forming apparatus 1 determines that the printing area PE for the bar code S1 and the embossing area HE for the braille characters are not overlapped with each other, and an ink-character printing process and a braille embossing process are started without causing the notifying screen D70 (see FIG. 6) to be displayed. Note that the matter relating to a state as to whether or not the printing area PE for the bar code S1 and the embossing area HE for the braille characters are overlapped with each other is dependent also on settings (character size, margin, character spacing, or the like) on the ink-character information, and various examples can be conceived in addition to the above-described ones.

Furthermore, the symbol image S such as a bar code and a two-dimensional code has quiet zones QZ serving as predetermined blank areas used for reading the same. According to the label forming apparatus 1 of the present embodiment, the area including the quiet zones QZ of the symbol image S to be printed on the tape T is set as the printing area PE for the symbol image S. As shown in FIG. 8, when the symbol image S represents the bar code S1, the quiet zones QZ are arranged on the front and rear sides thereof, and it is so designed that the printing area PE for the bar code S1 includes an area BZ, where respective bars constituting the bar code S1 are printed, and the quiet zones QZ. When the symbol image S represents a two-dimensional code S2, the quiet zones QZ are arranged on the front/rear and left/right sides thereof, and it is so designed that the printing area PE for the two-dimensional code S2 includes an area DZ, where respective dots constituting the two-dimensional code S2 are printed, and the quiet zones QZ.

In other words, even when the embossing area HE for braille characters is overlapped with the quiet zones QZ of the symbol image S, it is determined that the printing area PE for the symbol image S and the embossing area HE for braille characters are overlapped with each other. It is therefore possible to prevent braille characters from being overlapped not only with the symbol image S itself but also with the quiet zones QZ of the symbol image.

Figure 9A:
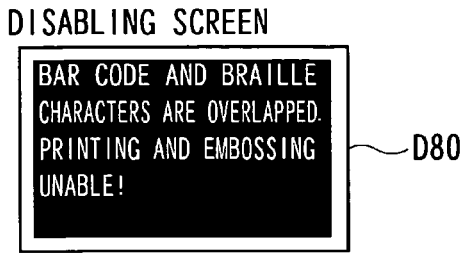
FIG. 9A shows a disabling screen D80 for disabling a printing process and an embossing process, and FIGS. 9B to 9D each show a layout of a tape with a width of 24 mm in which a printing area for a bar code and an embossing area for braille characters are overlapped with each other, and that in which the printing area for a bar code and the embossing area for braille characters are not overlapped with each other.

Description will now be made about a case in which the bar code S1 as the symbol image S is printed and a braille character B is embossed on the tape T with a width of 12 mm. In a procedure similar to that in the example of the 24 mm tape width (see FIG. 6), when the user instructs to start a printing process after inputting ink-character information including a bar code and braille information, the label forming apparatus 1 of the present embodiment sets a printing area for the ink-character information and an embossing area for the braille information based on the inputted various information and the selected layout, determining as a result whether or not the printing area PE for the bar code S1 and the embossing area HE for the braille characters are at least partially overlapped with each other. When it is determined that the printing area PE for the bar code S1 and the embossing area HE for the braille characters are at least partially overlapped with each other, a disabling screen D80 (see FIG. 9A) for disabling the printing process and the embossing process is displayed in place of the notifying screen D70 (see FIG. 6) displayed when the tape with a width of 24 mm is used, and the printing process and the embossing process are disabled.

This is because, when the printing area PE for the bar code S1 and the embossing area HE for the braille characters are at least partially overlapped with each other under the use of the tape with a width of 12 mm, there is a high possibility that the bar code S1 is not only hindered from being read but also rendered illegible. Therefore, when the disabling screen D80 is displayed, the user cannot continue the printing process and the braille embossing process unless he/she edits again so that the braille information and the ink-character information will not overlap each other.

Figure 9B:
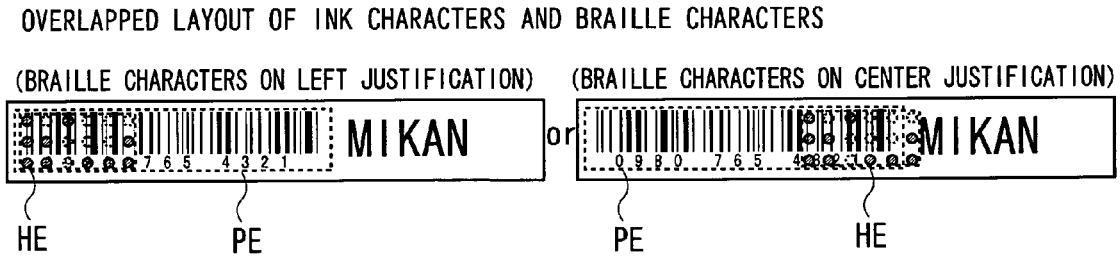
Figure 9C:
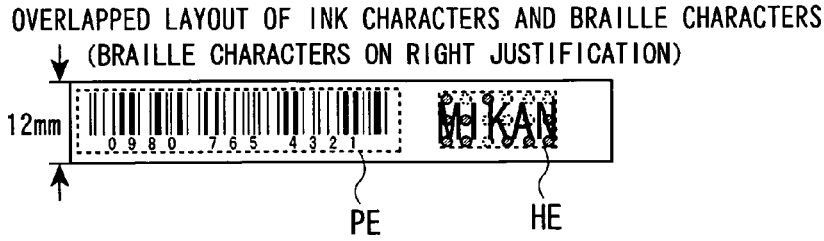
Figure 9D:
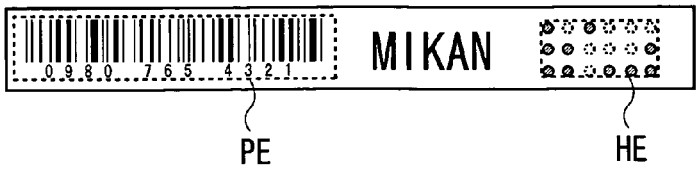

FIGS. 9B to 9D each show a case in which a "bar code" and a character string of "MIKAN," Japanese representing orange are inputted as ink-character information and the character string of "MIKAN" is inputted as braille information on the tape T with a width of 12 mm. They provide layout examples such as a case in which the label forming apparatus 1 determines that the printing area PE for the bar code S1 and the embossing area HE for the braille characters are at least partially overlapped with each other, or that in which it determines that the printing area PE for the bar code S1 and the embossing area HE for the braille characters are not overlapped with each other.

FIG. 9B shows examples in which the user sets a braille embossing area to either "LEFT JUSTIFICATION" or "CENTER JUSTIFICATION" under the overlapped layout of "INK CHARACTERS AND BRAILLE CHARACTERS" where ink characters printed in a desired size are partially overlapped with braille characters. In this case, the label forming apparatus 1 determines that the printing area PE for the bar code S1 and the embossing area HE for the braille characters are at least partially overlapped with each other, and the disabling screen D80 is displayed. On the other hand, FIG. 9C shows an example in which the user sets a braille embossing area to "RIGHT JUSTIFICATION" under the overlapped layout of "INK CHARACTERS AND BRAILLE CHARACTERS" where ink characters printed in a desired size are overlapped with braille characters, and FIG. 9D shows an example in which the user sets a layout to the non-overlapped type of "INK CHARACTERS AND BRAILLE CHARACTERS" where printing area for ink-character information and an embossing area for braille information are arranged side by side in the longitudinal direction of the tape T. As for both the cases of FIGS. 9C and 9D, the label forming apparatus 1 determines that the printing area PE for the bar code S1 and the embossing area HE for the braille characters are not overlapped with each other, and an ink-character printing process and a braille embossing process are performed without displaying the disabling screen D80.

As described above, when the printing area PE for the symbol image S, such as the bar code S1 and the two-dimensional code S2, and the embossing area HE for the braille characters are at least partially overlapped with each other, the label forming apparatus 1 of the present embodiment either notifies the user to that effect depending on the tape width involved or disables printing and embossing processes to work. Therefore, there is no possibility that the braille characters are embossed overlapping with the printing area PE for the symbol image S. In other words, it is made possible to prevent, in advance, the symbol image S from being printed in a way to cause an inappropriate reading to result.

Furthermore, the respective components (functions) of the label forming apparatus 1 shown in the foregoing examples can be provided as programs. They can be stored in a storage medium (not shown). The storage medium may be in the form of a CD-ROM, a flash ROM, a memory card (a compact flash (registered trademark), a smart media, a memory stick, etc.), a compact disk, a magnetic optical disk, a digital versatile disk, a flexible disk, or the like.

Note that the invention is not limited to the embodiments described above, but various modifications on the apparatus configuration, process, etc. of the label forming apparatus 1 are possible without departing from the spirit and the scope of the invention.

What is claimed is:

1. A printing-and-embossing composite apparatus which performs a printing process of a symbol image and an embossing process of a braille character on the same process sheet, the apparatus comprising:

a printing-area setting device for setting a printing area for the symbol image on the process sheet;

an embossing-area setting device for setting an embossing area for the braille character on the process sheet; and a notifying device for issuing an alarm when the printing area and the embossing area are at least partially overlapped with each other.

2. The printing-and-embossing composite apparatus according to claim 1, further comprising a process disabling device for disabling the printing process and/or the embossing process when the printing area and the embossing area are at least partially overlapped with each other.

3. The printing-and-embossing composite apparatus according to claim 1, wherein the printing area is formed of an actual printing area for the symbol image and a quiet zone arranged at the periphery thereof.

4. The printing-and-embossing composite apparatus according to claim 1, wherein the symbol image represents a bar code or a two-dimensional code.

5. A program embodied on a computer readable medium which causes a computer to perform each device of the printing-and-embossing composite apparatus according to claim 1.

6. A controlling method for a printing-and-embossing composite apparatus which performs a printing process of a symbol image and an embossing process of a braille character on the same process sheet, the method comprising issuing an alarm when a printing area for the symbol image and an embossing area for the braille character are at least partially overlapped with each other on the process sheet.

7. The controlling method for a printing-and-embossing composite apparatus according to claim 6, the method comprising disabling the printing process and/or the embossing process when the printing area and the embossing area are at least partially overlapped with each other.

* * * * *